US005598201A

United States Patent [19]

Stodder et al.

[11] Patent Number: 5,598,201

[45] Date of Patent: Jan. 28, 1997

[54] DUAL-RESOLUTION ENCODING SYSTEM FOR HIGH CYCLIC ACCURACY OF PRINT-MEDIUM ADVANCE IN AN INKJET PRINTER

[75] Inventors: Samuel A. Stodder, Encinitas; Paul J. Wield, Poway, both of Calif.

[73] Assignee: Hewlett-Packard Company, Palo Alto, Calif.

[21] Appl. No.: 189,354

[22] Filed: Jan. 31, 1994

[51] Int. Cl.[6] ..... B41J 2/01

[52] U.S. Cl. ..... 347/104; 347/16; 400/708; 271/272; 271/275

[58] Field of Search ..... 347/104, 16, 37, 347/262, 264; 400/708; 250/216.1; 271/272, 275; 318/665, 600–605, 280–286, 466–470

[56] References Cited

U.S. PATENT DOCUMENTS

| | | | |
|---|---|---|---|
| 4,734,868 | 3/1988 | DeLacy | 347/37 |
| 5,276,466 | 1/1994 | Tsukada et al. | 347/37 |
| 5,404,020 | 3/1995 | Cobbs | 250/548 |

FOREIGN PATENT DOCUMENTS

| | | | |
|---|---|---|---|
| 3006418 | 1/1988 | Japan | 250/231.16 |
| 63-6418 | 1/1988 | Japan | 250/251.16 |

*Primary Examiner*—John E. Barlow, Jr.

[57] ABSTRACT

The invention uses two very inexpensive rotary encoders in combination—a close-coupled one (or more) for high accuracy, and a remote-coupled one for high resolution. High-accuracy information is then combined with high resolution information in a digital processing system to yield composite information that is high in both accuracy and resolution. This information can be used to establish image positioning on a print medium. The overall system cost is lower than with an equivalent single encoder. Insidious cyclical errors in the coupling system (gear train or the like) are removable without expensive high tolerances and assembly or test fixtures. Residual cyclical error due to eccentric mounting or other error in the direct-coupled encoder scale also can be substantially removed, if desired, by adding another one or more encoders reading that scale, and suitably combining the information about that scale from the different sensors. The information is combined in such a way that the systematic cyclical errors cancel—or are quantified for use in explicit correction.

17 Claims, 5 Drawing Sheets

DUAL-RESOLUTION ENCODING SYSTEM FOR HIGH CYCLIC ACCURACY OF PRINT-MEDIUM ADVANCE IN AN INKJET PRINTER

BACKGROUND

1. Field of the Invention

This invention relates generally to a raster scanning device, such as an inkjet printer of the sort that constructs images as arrays of very large numbers of individually computer-controlled inkdrops on a printing medium that is computer-advanced in very small steps through the printer; and more particularly to encoder apparatus for very accurately advancing, or controlling the advance of, the printing medium through the printer.

Some large-format printers of this sort are sometimes called "plotters". For purposes of this document, except as indicated by context, the terms "printers", "printing devices" etc. encompass such plotters.

2. Related Art

In this field it is known to use position-encoding devices, or in abbreviated form "encoders", to help establish the position of a piece of printing medium relative to inkdrop-expelling modules, often called "pens" or "printheads", of a printer. An encoder generally has two main elements that are subject to relative movement.

One of these elements is—in one manner or another—extended along the direction of relative movement and has graduations that are, in effect, arrayed along that direction of movement. The other element is positioned to sense relative passage of such a graduation and in response produce some sort of signal that is expressed as or developed into a digital electronic signal.

In one type of encoder for a rotary-drive system, visible graduations are arrayed about the shaft or hub of a rotary drive element (a roller or platen), that directly engages and advances the printing medium; and an optical sensor is disclosed to respond with an electrical pulse to passage of each graduation. In such a rotary-drive system the only element that may be said to move linearly is the print medium itself.

If preferred instead, a linear drive element may be included—a print-medium-carrying bed that engages, holds and advances the medium. In this linear-drive case, graduations may be arrayed along the longitudinal extent of the bed; a sensor is disposed to respond to each graduation, generally as in the rotary case.

It will be understood that in most such systems whether linear or purely rotary, in purest principle it is immaterial whether the graduations are fixed relative to the moving drive element (platen or bed) and the sensor is stationary with respect to the rest of the printer, or the sensor is fixed to and rides on the moving drive element while the graduations are stationary. Hence all such topological inversions shall for purposes of this document be considered equivalents.

As suggested above, graduations may be primarily only visible features—such as painted or etched marks—or may partake of a more mechanical character as in the case of grooves, apertures or raised ribs. Naturally, the type of sensor employed varies accordingly.

One special case of well-known rotary encoder uses only one single graduation, which gives rise to just one sensor pulse for each rotation of the associated shaft. The graduation used in such a system may be a magnet fixed to a rotating shaft, and the sensor may be another magnetic element such as a second magnet or a coil of wire, mounted to respond mechanically or electrically to the rotating magnet.

Now with graduations arrayed along a linear drive element such as a print-medium-carrying bed, the relative movement of the medium with respect to the rest of the printer has a very simple relationship to the relative movement of the encoder sensor with respect to the encoder graduations. That relationship is one-to-one.

As a result, in such a linear encoder with one of the two elements (graduation array and sensor) essentially fixed relative to the printing medium and the other fixed to the rest of the printer, the precision of position determinations along the advance direction of the medium is limited by the resolution of the encoder system.

That resolution is the ability of the system to properly and reliably distinguish each graduation from the adjacent ones. This ability may also be described as the readability of the graduations through interpretation of the sensor pulses, or the precision with which the sensor pulses correspond to the passage of graduations past the sensor position.

In addition to these precision considerations, the accuracy of position determinations along the advance direction of the medium is limited by the positional accuracy of the encoder-system graduations. In the relatively simple case of a linear drive system, overall precision and accuracy of such positional determinations are not only set by but essentially equal to the precision and accuracy of the encoder system.

This relationship is relatively undesirable, for the desired printing precision is on the order of a small fraction of one millimeter (roughly 0.008 mm, or about 0.0003 inch). Such fine-resolution linear encoders are feasible, and in fact are used for printhead positioning in the direction transverse to printing-medium advance, in printers of the type under consideration.

Even for motion along that transverse direction (which is usually much shorter than the print-medium advance), such encoder systems are relatively very expensive, generally requiring very finely spaced graduations—as for example in the form of very narrow apertures etched in a metallic strip—and two sensors very precisely spaced apart and read in quadrature to effectively interpolate between those fine graduations. For the print-medium advance direction an even longer array of graduations would be required.

In any event such a system could be practical for a driven-linear-bed printer, but currently such mechanisms are disfavored for economic reasons in ordinary commercial printers, and in printers that make very long engineering-size drawings as for instance on continuous paper rolls. Current practice favors mechanisms that drive the printing medium itself—with no relatively costly and heavy suspended movable platform or bed—through the printer by rollers or around platens.

It is known in the art to use an encoder to establish position in such a rotary-drive system, with one of the encoder elements fixed directly to the shaft or hub of a drive platen and the graduations arrayed about the platen axis. (For some purposes of this document it will be convenient to refer to such an encoder in a verbal shorthand as a "direct-coupled encoder" or in even more-abbreviated form a "direct encoder".) If this scale is radially positioned near the platen or roller circumferential surface, the resolution along the print medium, as in the linear case is essentially equal to the linear resolution of the encoder system itself— which is to say, ordinarily, the spacing of the encoder graduations.

In a rotary system the angular resolution of the encoder system and thereby the linear resolution along the print medium can be improved by placing the array of graduations—and its associated sensor—at a greater radius from the platen or roller axis. With larger radius one can provide a greater number of divisions, or readable divisions, in each rotation of the shaft. The resulting improvement in fineness of linear resolution along the medium is proportional to the ratio, or multiple, of graduation-and-sensor radius relative to platen radius.

As a practical matter, however, this multiple is limited by available space within the printer case; moreover, problems of concentricity can become significant with increasing radius. Also a large graduated disc may introduce new concerns such as cost of manufacture, or mechanical and thermal stability.

Further, in a rotary system new variables come into play; one of these is the systematic error introduced by effective radius of the printing-medium surface on which the printer makes marks. The effective radius is influenced by thickness of the medium itself, and by manufacturing tolerances and, in principle, wear in the platen.

Another variable is circumferential slippage of the medium relative to the platen. It is known to provide means for measurement of the aggregate effect of these variables in situ by a printer user in the field, and to program a microcomputer which controls each printer to compensate for these measured variables by taking them into account in calculating position along the medium-advance direction.

Thus in one printer that is commercially available from the Hewlett Packard Company, marks are made automatically by the printer along the pen-advance direction—at right angles to medium advance. These marks are made on a piece of the same printing medium that is to be used in accurately-positioned printing along the medium-advance direction, to form a special, customized scale.

The printer user then rotates the scale-printed piece of printing medium through a right angle and reinserts the piece, thus oriented, for passage through the printer in the ordinary advance mode. The printer has optical sensors for finding the custom-scale marks, and its control computer has programming for using the marks to determine the composite effects of diametral tolerance (and theoretically wear), and slippage, to develop a calibration table for use in later operation to correct the information provided by the encoder system.

Such a system has the important advantage of compensating for print-medium thickness and wear—systematic factors which affect accuracy and which cannot be known when the printer is manufactured. It also corrects for limited other kinds of systematic errors, such as cyclical errors due to warping of a platen or drive roller and due to eccentric placement of the encoder scale relative to the platen or roller axis.

As will be clear, nevertheless, this system is somewhat awkward to use and in any event cannot improve the resolution or precision of a medium-advance-direction encoder system, beyond the resolution and precision which are mechanically inherent in it.

Countering the larger-radius/greater-number-of-divisions approach is a philosophically opposite one, embodied in the single-graduation type of rotary system mentioned earlier. Since just one pulse is produced for each shaft rotation, and a typical printing-medium platen or drive roller has radius between about 5 mm to 3 cm, poor resolution (about 1% to 9 cm) would result from placing such a system directly on the platen or drive-roller shaft.

Even with modification to count two or four pulses per shaft rotation (as for example by counting both ends of a permanent magnet mounted crosswise to the shaft), such resolution is entirely inadequate for modern purposes in which desired resolution amounts to small fractions of a millimeter.

Therefore it is common to place such single-graduation (or small-number-of-graduation) encoders on shafts that operate at a very large mechanical advantage relative to the shaft whose position is to be measured. For example such encoders may be placed on shafts that are linked by belt or gear drives that provide a mechanical advantage of 100:1 to perhaps 10,000:1. (For verbal-shorthand purposes in this document such an encoder will sometimes be called a "remote-coupled encoder" or even more simply a "remote encoder".)

To avoid the incremental cost of providing such a drive for positional measurement exclusively, it is known to mount such an encoder to the shaft of a motor that is in the system anyway—i.e., a motor that drives the printing-medium platen or roller—and that is linked to the platen through a gearbox that is likewise in the system already.

In this case a further subdivision of each rotation by a medium-size factor (for example, perhaps eight to sixty-four) can be obtained through use of a stepping motor. A stepping motor is in effect a special case of a magnetic encoder, since the armature and stationary coils of such a motor provide—in addition to motive force—a rotation-counting (or partial-rotation-counting) function that is equivalent to the response of an encoder coil to its rotating magnet. To that extent this type of motor is in essence self-encoding, but at significant added cost.

Whether a stepping motor or a separate graduation-and-sensor encoder is used, the interposition of a gearbox or other means for providing a mechanical advantage introduces still other undesirable effects. These are various phenomena that can lead to imprecise and inaccurate correspondence between advance of the encoder (or self-encoder) count and the theoretically corresponding linear advance of the printing medium.

Foremost among these are cyclical errors arising from eccentric or otherwise imperfect gears. Some more insidious effects can intrude, such as—in bidirectional medium-advance systems for instance—inconsistent takeup of backlash. Thus while medium-advance-direction encoders have been used in sophisticated ways heretofore, such use has not focused on dealing with resolution and precision, or with gear-train-generated cyclical errors and their related problems.

From all this it can be summarized that systems in which encoder elements move nearly directly with the printing medium—while highly accurate—are subject to relatively poor resolution; whereas systems in which encoder elements move with a high mechanical advantage relative to the printing medium, while offering fine resolution, are subject to unacceptable systematic inaccuracies. The first type of system can be rendered technically acceptable only through use of relatively expensive, high-resolution encoders; while the second type can be rendered technically acceptable only through use of relatively very expensive high-precision gearing.

Even in very expensive encoders, cyclical errors of still another type are typically present: errors in or associated with the encoder discs. These errors are due to mounting eccentricity, mounting perpendicularity, cyclical errors in mastering equipment used for generating an original pattern of graduations (which may later be replicated myriad times as by silkscreening or photoetching), and other contributors. In earlier systems these error sources can be controlled only by high tolerancing and careful, expensive mounting technique.

As can now be seen, important aspects of the technology which is used in the field of the invention are amenable to useful refinement, as no system has been introduced that offers both high resolution and good systematic accuracy at relatively modest cost.

SUMMARY OF THE DISCLOSURE

The present invention introduces such refinement. Before offering a relatively rigorous discussion of the present invention, some informal orientation will be provided here.

It is to be understood that these first comments are not intended as a statement of the invention. They are simply in the nature of insights that will be helpful in recognizing the underlying character of the prior-art problems discussed above (such insights are considered to be a part of the inventive contribution associated with the present invention)—or in comprehending the underlying principles upon which the invention is based.

As mentioned in the preceding section, high positional accuracy can be obtained at modest expense by using a close coupling between the most direct print-medium drive element and the encoder (that is, by fixing one side of the encoder-scale/sensor pair to the platen or final drive roller). Conversely, high resolution can be obtained at modest expense by using a remote coupling—through a large mechanical advantage—between the encoder and that most direct drive element.

The present invention uses plural very inexpensive rotary encoders in combination—a close-coupled one (or more) for high accuracy, and a remote-coupled one for high resolution. High-accuracy information is then combined with high-resolution information in a digital processing system to yield composite information that is high in both accuracy and resolution. This information can be used to establish image positioning on a print medium.

The overall system cost is lower than with an equivalent single encoder. Insidious cyclical errors in the coupling system (gear train or the like) are removed without expensive high tolerances and assembly or test fixtures.

Residual cyclical error due to eccentric mounting or other error in the direct-coupled encoder scale also can be substantially removed, if desired, by adding another one or more encoders reading that scale, and suitably combining the information about that scale from the different sensors. The information is combined in such a way that the systematic cyclical errors cancel—or are quantified for use in explicit correction.

Now with these preliminary observations in mind this discussion will proceed to a perhaps more-formal summary. The invention has more than one major facet or aspect.

In preferred embodiments of a first of these main aspects or facets, the invention is apparatus for controlling print-medium advance in an inkjet printer. The apparatus includes some means for engaging and advancing such a print medium; for purposes of breadth and generality in describing the invention, these means will be called simply the "engaging-and-advancing means".

The apparatus also includes some means for providing a first electronic signal representing position of the engaging-and-advancing means. Again for generality and breadth these will be called the "first position-monitoring means". The first position-monitoring means are coupled substantially directly to the engaging-and-advancing means.

In addition the apparatus has some means for providing a mechanical advantage—for breadth and generality, the "mechanical-advantage means"—which are coupled to the engaging-and-advancing means. The mechanical-advantage means have an element that moves in approximate correspondence with motion of the engaging-and-advancing means, but which element has a mechanical advantage relative to the engaging-and-advancing means;

Further the apparatus includes some means for providing a second electronic signal representing position of said element. These means, for purposes of this document denominated the "second position-monitoring means" are coupled substantially directly to the above-mentioned element of the mechanical-advantage means.

The apparatus also has some digital electronic means for receiving the first and second electronic signals and combining them to obtain hybrid information representing position of the engaging-and-advancing means.

The foregoing may be a description or definition of the first main aspect of the present invention in its broadest or most general terms. Even in such general or broad form, however, as can now be seen the invention resolves the previously outlined problems of the prior art.

In particular the apparatus of this first facet of the invention suffers neither from low accuracy nor from low resolution—but by virtue of its manner of construction it can employ relatively very inexpensive, low-resolution devices for both the first and second monitoring means and so can be manufactured for less than a single encoder of high resolution and accuracy.

Although the invention thus provides very significant advances relative to the prior art, nevertheless for greatest enjoyment of the benefits of the invention it is preferably practiced in conjunction with certain other features or characteristics which enhance its benefits.

For example, it is preferred that the engaging-and-advancing means be rotary; and that the first signal, provided by the first position-monitoring means, represent angular position of the rotary engaging-and-advancing means. In such a preferred system it is further preferable that the first position-monitoring means include:

- a single reference pattern mounted for rotary motion with the engaging-and-advancing means; and
- plural sensors, spaced about an axis of the engaging-and-advancing means, for reading the single reference pattern substantially concurrently and generating respective sensor signals; and
- some means for combining signals from the plural sensors to obtain a signal of relatively high cyclical accuracy, in comparison with each of the plural sensor signals considered individually.

Reverting to the most broad, general form of the first aspect of the invention, it is also preferable that the mechanical-advantage means include a gear train, having at least one gear pair. The gear train should be coupled at one end of the train to the engaging-and-advancing means and coupled at the other end of the train to the element of the mechanical-advantage means.

Also preferably the first monitoring means and first signal have relatively high cyclical accuracy but are subject to relatively low resolution, in comparison with the second monitoring means and second signal; whereas the motion of the element, and accordingly the second monitoring means and second signal, have relatively high resolution but are subject to relatively lower cyclical accuracy, in comparison with the first monitoring means and first signal. In this preferred system the digital electronic means include means for combining the signals to obtain hybrid information whose:

cyclical accuracy is established by the cyclical accuracy of the first monitoring means, and resolution is established by the resolution of the second monitoring means.

Again reverting to the most general form of the first main aspect of the invention, in one preferred embodiment of the apparatus the digital electronic means include means for combining the signals by using:

the first signal to establish absolute position of the engaging-and-advancing means; and the second signal to establish relative position between absolute positions determined from the first signal.

Thus for example the first signal may include electronic pulses that are counted; and the second signal may include electronic pulses that are counted. The digital electronic means then include some means for combining the signals by using pulses of the second signal to establish relative position between pulses of the first signal.

This system may be further refined by including in the digital electronic means further some means for comparing the first and second signals to determine cyclical error in the second signal; and some means for applying that determined cyclical error to refine the second signal as used to establish relative positions between absolute positions determined from the first signal. This further refinement should be reserved for unusual cases; ordinarily it will be neither necessary nor desirable, because cyclical errors normally are developed within representative mechanical-advantage means such as gear trains, and are relatively so small as to be insignificant when accumulated only over very short distances such as the interval between two pulses of the first (low-resolution, high-accuracy) signal.

In an alternative preferred embodiment of the most general form of the first aspect of the invention, the digital electronic means instead include (1) means for comparing the first and second signals to determine cyclical error in the second signal; and (2) means for applying that determined cyclical error to derive from the second signal a unitary signal that has relatively very high cyclical accuracy. In this alternative preferred embodiment the digital electronic means also include means for using this derived unitary signal to represent the position of the engaging-and-advancing means.

This alternative may seem more roundabout than the earlier-mentioned preferred embodiment in which the second signal is simply used to determine position between pulses of the first signal. The digital electronic means, however, while readily implementable in the form of hard-wired discrete electronic logic elements—or in the form of one or more special-purpose printed circuits combining such logic elements as integrated circuits—may preferably take the form of a programmed general-purpose microprocessor.

Many procedures when implemented through use of such a programmed processor can turn out to be less expensive and even faster in actual execution if the processor is caused to first do some extensive preliminary arithmetic, storing the results—and then resort to those cumulated results at actual operating time. If a programmed processor is used, then as will be understood the various "means" included within it, and enumerated in this discussion, are most naturally implemented in the form of program or so-called "firmware" modules incorporated within the processor and any associated memories.

Thus in the present instance this alternative preferred embodiment of the first general aspect of the invention may in turn be preferably practiced by making the error-applying means include means for forming a digital electronic lookup table—a table correlating tabulated values of the second signal with tabulated values of the high-cyclical-accuracy unitary signal. These tabulated values of the high-cyclical-accuracy unitary signal constitute the hybrid information.

The derived-signal-using means then include means for using tabulated values of the high-cyclical-accuracy unitary signal to represent the position of the engaging-and-advancing means. The overall result is that the system, having driven any distance as represented by counted pulses of the second signal, can determine the actual position of the engaging-and-advancing means.

Equivalently, the tabulation can also be used in the reverse manner—that is to say, starting from the unitary signal representing a desired position of the engaging-and-advancing means, looking up the correlated value of the second signal. This reverse procedure enables the system to determine how far to drive to reach any desired position.

A practical printer includes some motive means for driving the engaging-and-advancing means, and most typically these are coupled to the engaging-and-advancing means through some mechanical-advantage means such as mentioned already are a part of the invention. Accordingly it is preferable that the second position-monitoring means monitor the position of the motive means substantially directly, thereby causing single mechanical-advantage means to do double duty—both driving the print medium and providing the desired mechanical advantage that the invention uses to acquire high-resolution information.

The second position-monitoring means may include either an encoder coupled substantially directly to the motive means or a stepping drive mechanism that is part of the motive means.

In a second of its main aspects or facets the invention is apparatus for controlling printing-medium advance in an inkjet printer. The apparatus includes a codewheel disposed for monitoring angular position of a mechanical element that advances a printing medium; this codewheel has graduations that are objectionably subject to harmonic errors.

The apparatus of this second main facet of the invention also includes plural sensors arrayed about the codewheel at equal angles to provide signals corresponding to the codewheel graduations—with mutually complementary harmonic-error phase.

In addition this second major aspect of the invention includes some means for combining the signals to develop composite information in which particular harmonic errors are mutually cancelled.

While the foregoing may constitute a description or definition of the second facet of the invention it its most broad or general form, nevertheless even in this broadly couched form the invention resolves the sometimes-severe problems of gear error and codewheel error, mentioned in an earlier section of this document. Yet once again some preferable additional features or characteristics can be identified.

For example it is preferred that the apparatus further include an additional encoder intercoupled through mechanical-advantage means with the codewheel. Signals from this additional encoder are objectionably subject to cyclical errors that typically arise in the mechanical-advantage means.

The apparatus also preferably includes some means for combining signals from the plural sensors respectively with signals from the additional encoder to develop composite information about the cyclical errors; and means for applying that cyclical-error information to calibrate the apparatus and thereby provide positioning control that is independent of the cyclical errors.

In preferred embodiments of a third main aspect or facet, the invention is a method for inkjet printing on a print medium in an inkjet printing machine. The machine is one that has first and second position-monitoring means, intercoupled by mechanical-advantage means; the first position-monitoring means are relatively directly coupled to the print medium.

The method includes the step of engaging the print medium and advancing its position through the printing machine. It also includes the step of, during the advancing, using the first monitoring means to automatically develop a first electronic signal that accurately represents the position of the print medium.

The method also includes the steps of using the mechanical-advantage means to magnify the position of the print medium; and—during the advancing and magnifying steps—using the second monitoring means to automatically develop a second electronic signal that represents the magnified position of the print medium.

In addition, the method includes the step of automatically combining the first and second electronic signals to obtain hybrid information accurately representing the magnified position of the print medium. These steps may constitute a definition or description of the third facet of the invention in its broadest or most general form; even in such a general form this third aspect of the invention may be seen to provide desirable refinements not heretofore found in the art, but preferably this facet of the invention is practiced with additional method features or characteristics that optimize and thereby enhance its benefits.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
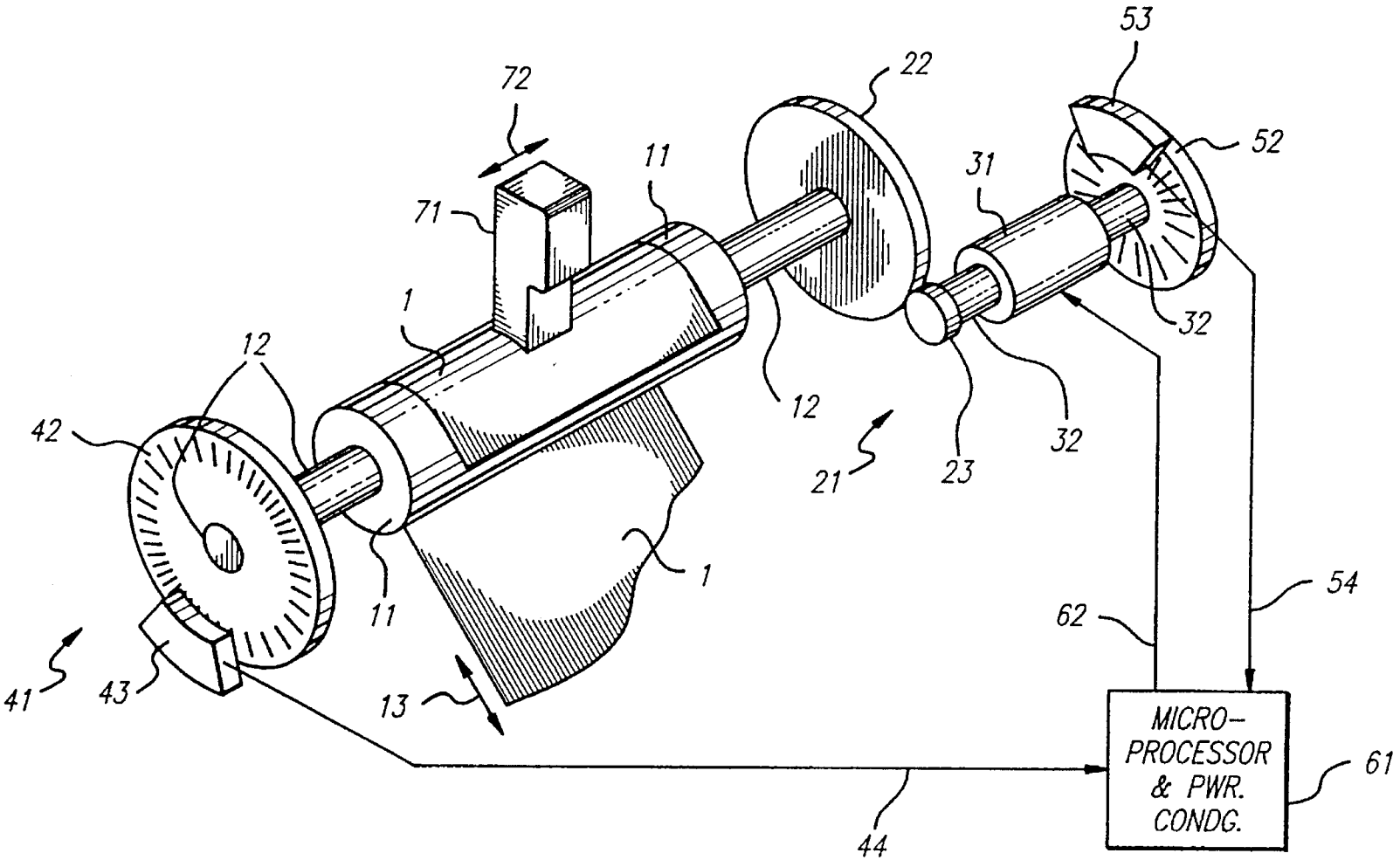
FIG. 1 is a somewhat schematic perspective or isometric view of a print-medium drive train incorporating one preferred embodiment of the invention, for determining and controlling print-medium advance—including two encoders of an optical-transmission type.

As FIG. 1 shows, in accordance with the invention two encoders 41, 51 are linked through a gear train 21. The gear train 21 consists of a spur 22 on the shaft 12 of the print-medium drive platen/roller 11, and a pinion 23 that engages the spur 22 and rides on a shaft 32 of a motor 31.

The motor 31, train 21 and roller or platen 11 together advance 13 a piece of printing medium 1 longitudinally relative to a printhead or pen 71. The pen 71 is mounted for transverse motion 72 to mark on the medium 1, at coordinate positions established orthogonally by the medium advance 13 and pen motion 72, all as well known in the art.

Each encoder 41, 51 includes a respective encoder disc 43, 53 and encoder sensor 41, 51. One encoder disc (or so-called "codewheel") 42 is on the platen shaft 12 and the other 52 on the motor shaft 32. Accordingly the latter encoder disc 52 has a mechanical advantage relative to the platen 11.

(In this specifically illustrated system, in fact, mechanical power flows from the shaft 32 carrying the encoder disc 52 to the platen shaft 12; as will shortly be understood from other examples, however, this direction of power flow is not a requirement of the invention—and is not any part of the meaning of the phrase "mechanical advantage", at least as used in this document.)

Both encoders 41, 51 are essentially equivalent low-resolution, low-cost devices; however, the remote-coupled encoder 51 has higher effective resolution with respect to the platen 11 because of the motion amplification due to the gear train 21. Accuracy is typically lost through the train 21; however, the direct-coupled encoder 41 provides the angular accuracy reference at the platen 41 without the gear error.

Essentially as a system the remote-coupled encoder 51 provides, through the gear train 21, the high resolution required—while the direct-coupled encoder 41 provides the accuracy. This arrangement assumes that the relevant spatial frequencies of the gear train 21 are larger than the line-spacing frequency of the direct-coupled encoder 41.

In other words, in the angular-rotation domain, the repetitions of significant cyclical errors introduced by the gearing 21 are spaced further apart (preferably much further apart) than the direct-encoder 41 graduations. For the system illustrated, this condition is very readily met by avoiding use of an extraordinarily high spur-to-pinion 22, 23 ratio; however, care should be taken in this regard if two or more gear stages 21 in series are employed.

Both sensors 43, 53 in FIG. 1 are optical-transmission types. Both discs 42, 52 are viewable using transmitted light—either generally transparent discs carrying opaque graduations, or generally opaque discs with light-transmitting narrow slits serving as graduations.

Transparent discs 42, 52 for this purpose may be of glass or plastic with graduations preferably applied by silkscreening or photochemistry. Generally opaque discs 42, 52 are preferably of metal, with the fine slits preferably photoetched.

A single solid drive roller or platen 11 may be preferred and illustrated, but within the scope of the present invention may be replaced by two or more narrower drive rollers (not illustrated) spaced along the shaft 12. The invention is also amenable to substitution of a plural-stage gear train, for example one with higher mechanical advantage—and in that case if preferred the second encoder 51 may ride on any of the intermediate gear shafts rather than the motor shaft 32.

It is also to be understood that the second encoder 51 need not be along the drive gear train 21 at all, but rather if preferred may have its own gear train, belt drive, or other mechanical-advantage means (not illustrated)—driven from the platen or roller 11. In such a system, despite the fact that the encoder 51 has a "mechanical advantage" relative to the platen 11, mechanical power passes from the platen 11 along the mechanical-advantage means to the encoder 51, rather than in the opposite direction; thus again it will be understood that use of the phrases "mechanical-advantage means" and "mechanical advantage" shall not be interpreted to mean that power must necessarily pass along the mechanical-advantage means from the second encoder 51 to the platen 11.

Still further the second encoder 51 may be operated by a separate gear train (not illustrated) which is driven from the motor 31 but is not in the drive train 21 to the platen 11. Such a separate gear train may be geared even further down (relative to the platen shaft 12) than the motor 31, or may be geared partway back up.

Here too, although the second encoder 51 has a mechanical advantage relative to the platen 11 no mechanical power flows from the encoder 51 to the platen 11. In any of these variants, for purposes of the present invention the second encoder 51 should have a net mechanical advantage, provided by some mechanical-advantage means, relative to the platen shaft 12.

In operation, encoder signals 44, 54 from the respective encoders 41, 51 proceed (most typically through respective conventional signal-conditioning preamplifiers, not illustrated) to digital electronic means for combining the signals—such as preferably a programmed microprocessor 61. As mentioned earlier this processor 61 with its incorporated firmware embodies the various previously introduced means and submeans for combining these signals to obtain hybrid information representing position of the platen/roller 11 or other engaging-and-advancing means.

Figure 5:
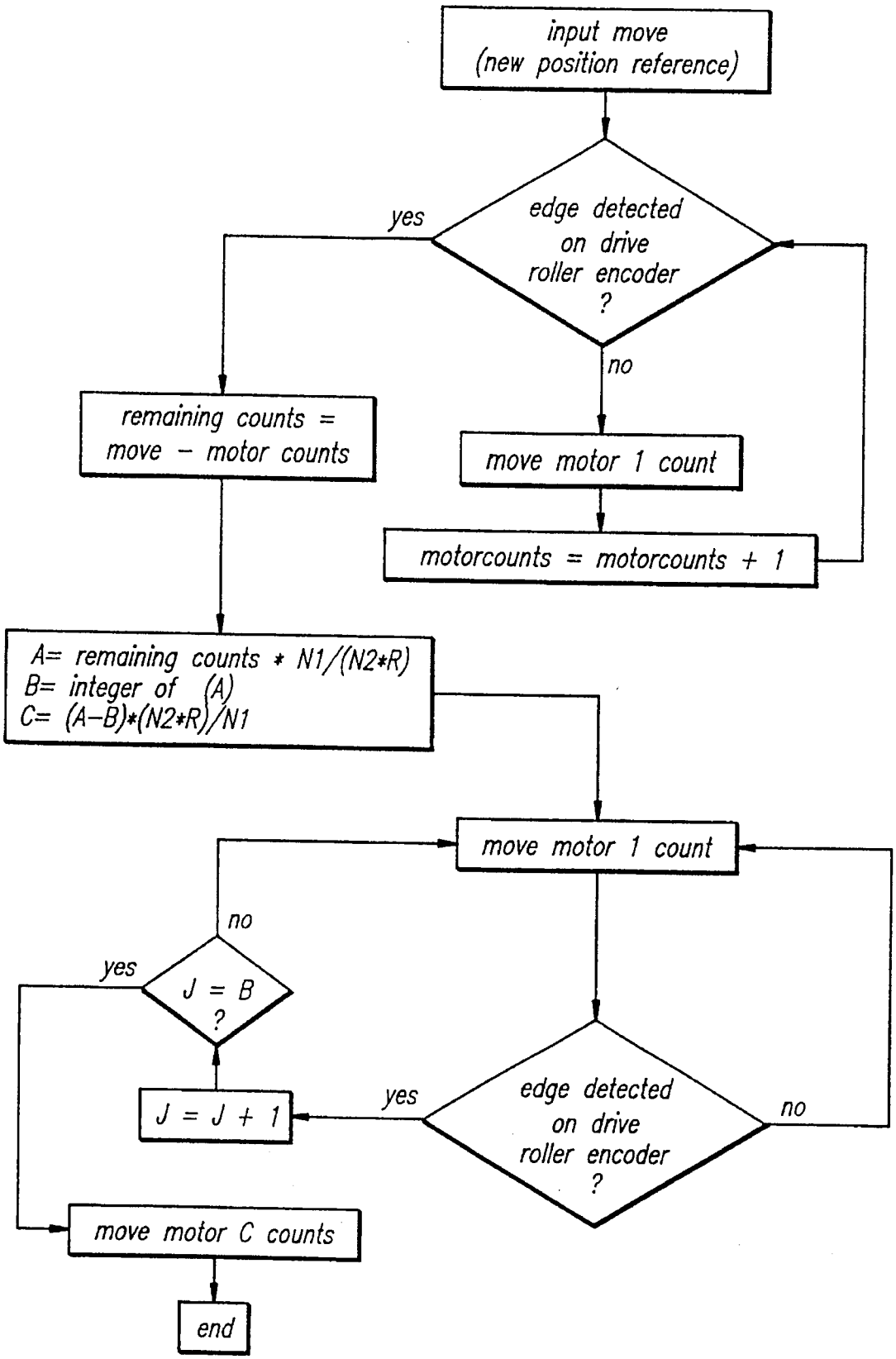
FIG. 5 is a representative flow chart showing internal firmware operations of a programmed microprocessor to effectuate the procedures described in this document.

The above-described embodiment of the invention advantageously functions as indicated in the firmware flow chart of FIG. 5. In this diagram "N1" represents the resolution of the direct-coupled encoder 41, 141, 241 (FIGS. 1 through 3)—in units of counts per revolution; and "N2" represents the motor 131 resolution in steps or counts per revolution, or equivalently the resolution of the motor-coupled encoder 51, 251. The variable "R" is the mechanical advantage (for example, gear ratio)—so that the product "N2*R" is motor resolution in steps or counts per revolution of the drive roller, which is to say in units compatible with those of N1.

"Edge" means the leading edge of a graduation or scale indicium on the direct-coupled encoder wheel 42 (FIG. 1); the letters "i" and "j" are each used to represent an index in a counter; and the variables "A", "B" and "C" are defined by operation of the microprocessor as set forth in the drawing. For readers skilled in the arts of microprocessor programming and inkjet-printer positioning control, this diagram will otherwise be self explanatory.

Figure 2:
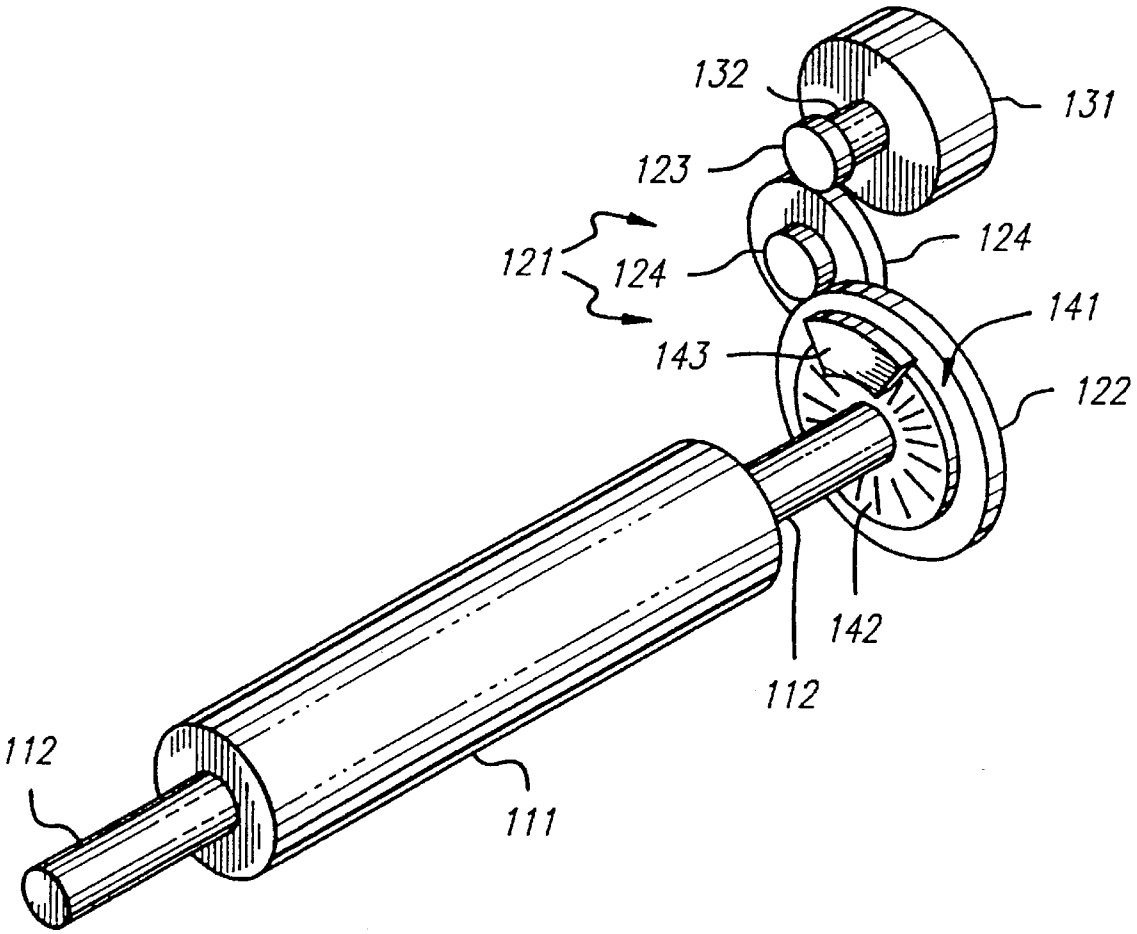
FIG. 2 is a like view of a drive train incorporating another preferred embodiment of the invention—including one encoder of an optical-reflection type and (in lieu of a second encoder and ordinary motor) a stepping motor used to drive the system.

As FIG. 2 suggests, any of the encoders may be a reflective 141 rather than transmissive (41, 51 in FIG. 1) type—thus enabling reduction of cost by elimination of a mechanical element (with mechanical arrangements for shaft mounting) in favor of a decal, foil disc or film 142. Such a thin element 142 may carry the graduations in the form of printed, silkscreened or photochemically formed indicia, and may be adhesive-mounted to the side of a gear 122; indeed if preferred the graduations may be silkscreened or photochemically applied directly to the surface of a gear 122.

FIG. 2 also shows that within the scope of the invention a self-encoding stepper motor 131 can be substituted for the second encoder 51 (FIG. 1) and ordinary motor 31. In addition this drawing exemplifies the point made earlier that a two-or-more-stage gear train 121 having, for instance, an intermediate cluster gear 124, can replace the single stage train 21 of FIG. 1. Such a plural-stage train 121 may facilitate attainment of a higher overall gear ratio, which is desirable with a stepping motor 131 because the angular resolution of such a motor 131 typically is much lower than available with even a very inexpensive encoder 51.

Even higher accuracy of inkjet printer medium-advance position control can be obtained by eliminating cyclical errors in or associated with codewheels (particularly the direct-coupled encoder disc 41, 141). As mentioned earlier such errors arise in graduation-pattern generation, or from eccentric or nonperpendicular mounting, etc.

The need for careful mounting and demanding tolerances can be eliminated in accordance with the present invention by incorporating an additional encoder signal that is 180° out of phase relative to a particular cyclical error which is of concern. For instance, addition of another encoder transducer **243*b* (FIG. 3) to the direct-coupled encoder 241** enables elimination of first-harmonic cyclical error—that is to say, once-per-revolution error.

For this purpose the second transducer **243*b* is mounted directly opposite to the first transducer 243*a* (180° out of phase). The respective signals 244*a*, 244*b* from the two transducers 243*a*, 243*b* are averaged 263 to obtain a single signal 244 that proceeds to the microprocessor (61 in FIG. 1, not shown in FIGS. 2 and 3**).

In the processor the single, average signal 244 is used as representative of the platen 211 position. The error components of the two signals **244*a*, 244*b* are 180° out of phase with each other and thus cancel when averaged; the remaining signal 244** is free of first-harmonic error.

In a like manner, nth-harmonic errors can be eliminated. This is enabled by using a greater number, for example 2n, of transducers 243.

The processor 61 also automatically controls other motive means (such as another motor) to effect the pen scanning 72, and furthermore controls the pen-firing mechanisms to mark on the print medium 1. The processor 61 thus encompasses automatic means, integrated with the digital electronic means that control the print-medium advance, for operating the pen-scan motive means and for operating the marking by the pen.

The present invention may be regarded as in effect utilizing graduations of the remote-coupled encoder 51, 251 or steps of the stepper motor 131, as sensed, to interpolate between graduations of the direct-coupled encoder 41, 141, 241. Cyclical errors in the remote-encoder 51, 251 graduations or stepper 131 steps, as sensed, do act as perturbations in uniformity of this interpolation—and accordingly such cyclical errors should be held to an insignificant level over the short distance or angular interval between graduations of the direct encoder 41, 141, 241.

This very desirable condition is ordinarily met with ease, if (as mentioned earlier) the spatial or angular periodicity of the cyclical errors is made much larger than the spacing of graduations in the direct-coupled encoder 41, 141, 241. When this periodicity relationship is observed, then over the limited interval between direct-encoder graduations the spacing of interpolation graduations is reasonably well behaved—that is to say, either very nearly constant (as near a peak or trough of the cyclical errors) or essentially very slow and monotonic in variation.

In some cases, as perhaps for example when unusually high mechanical advantage is desired for some reason, the cyclical errors may not be readily kept insignificant over the interval between direct-encoder graduations. In such a situation a designer may resort to an alternative condition, namely that the magnitude of the cyclical errors—that is, the variation in remote-encoder 51, 251 graduation spacing or stepper 131 steps as sensed—be much less than the spacing of the direct-encoder 41, 141, 241 graduations.

Compliance with this alternative condition can be forced by a further application of the principles of the invention. In this case the remote encoder 51, 251 or stepper 131 with its high resolution (through the gear train 21, 121, 221) is used in combination with plural or multiple transducers 243 (FIG. 3) of the direct encoder 241, to reduce the effective cyclical error to a level that is much smaller than the direct-encoder 241 graduation spacing.

Figure 3:
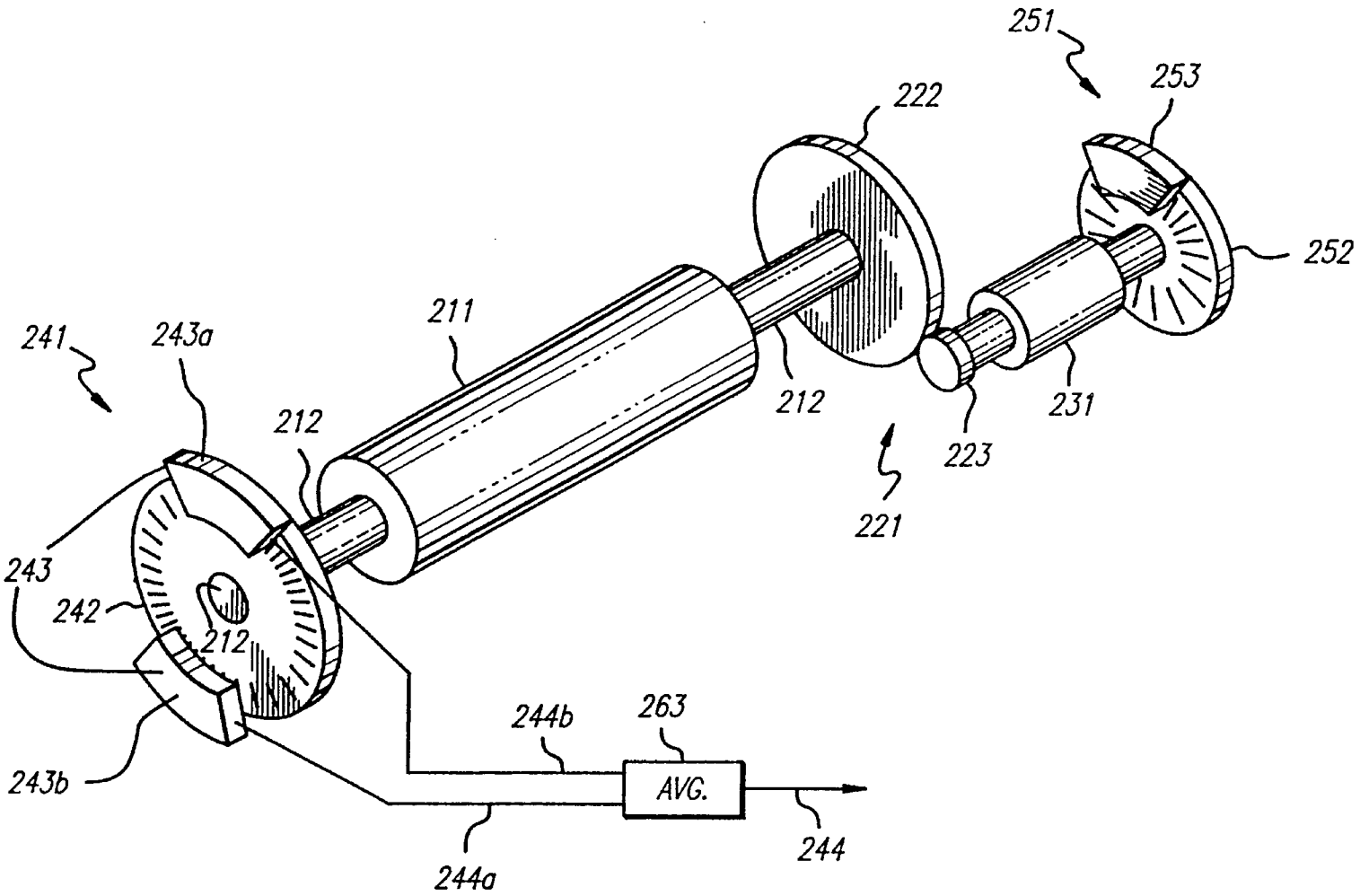
FIG. 3 is a view similar to that of FIG. 1 but of a drive train incorporating yet another preferred embodiment of the invention—including plural sensors as part of the direct-coupled encoder.

This is achieved—for the two-sensor 243 case illustrated in FIG. 3—by making two comparisons with the signal from the remote encoder 251: (1) comparison of that signal with the signal from a first sensor or transducer 243*a* of the direct encoder 241, and (2) comparison of that same remote-encoder signal with the signal from a second sensor or transducer 243*b* of the direct encoder 241. As mentioned earlier this second transducer 243*b* is opposed to or 180° out of phase with the first 243*a*. Each of the two comparisons yields a signal with mixed gear error and direct-encoder cyclical error.

The direct-encoder 241 cyclical errors that are embedded in the two comparison signals respectively, however, are not the same. More specifically, they are mutually 180° out of phase.

The two mixed-error comparison signals are then averaged. To the extent that the direct encoder 241 error is free of second and higher harmonics, the averaging yields gear 221 error data only, since the codewheel 242 first-harmonic cyclical error cancels out. These gear 221 error data thus determined are applied as high-resolution calibration data, to be applied at the direct encoder 241 to accurately move the roller 211, through the gearing 221.

A greater number of transducers 243 may be employed, as described earlier, in combination with this error-isolating technique to reduce the accuracy-degrading effects of second- and higher-harmonic errors if such perturbations are found to constitute a practical problem. All such plural-sensor-per-codewheel variants are addressed to the improvement of overall positioning accuracy, as distinguished from resolution.

Figure 4:
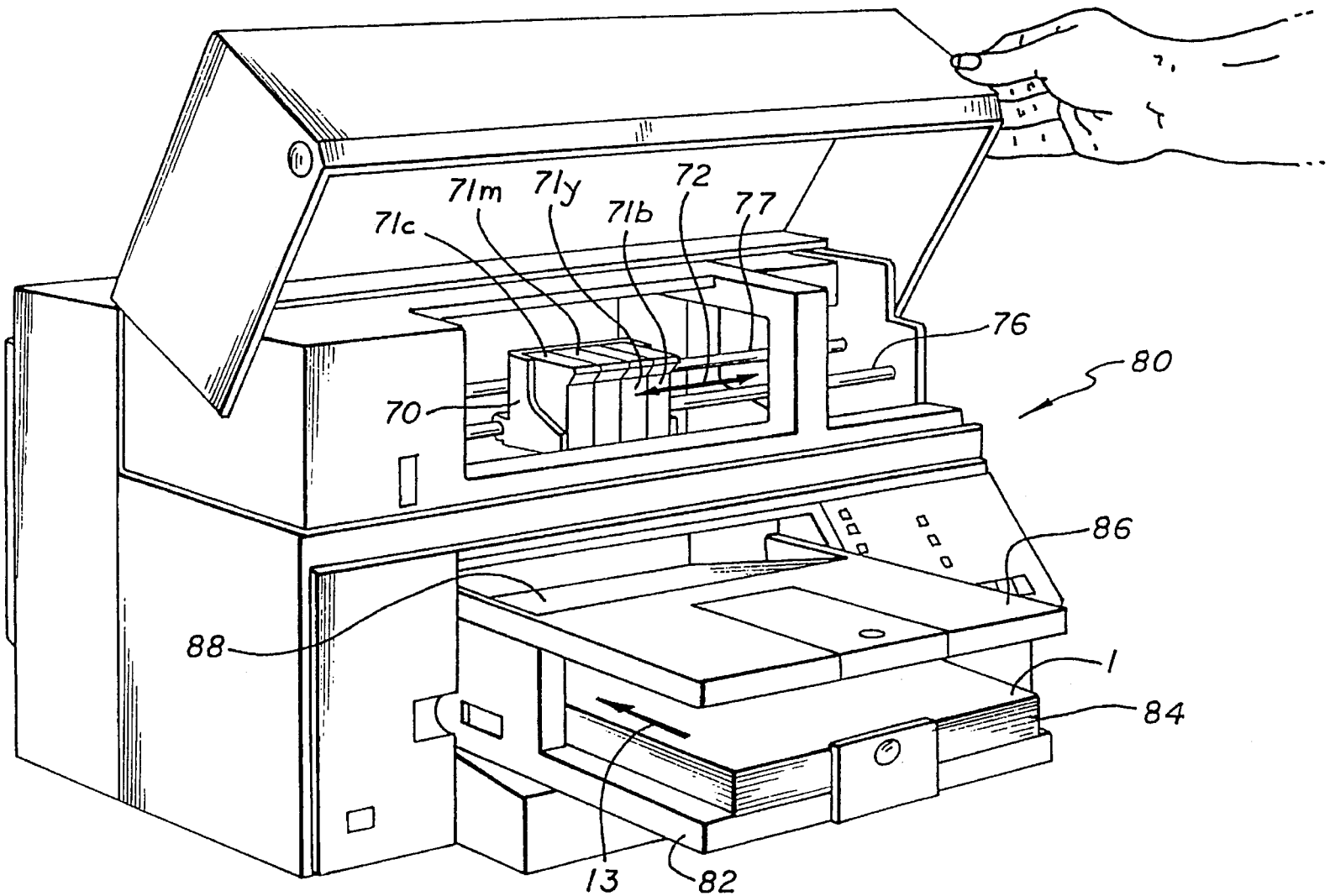
FIG. 4 is an isometric or perspective view of a printer in accordance with the invention and as recited in certain of the appended claims.

The invention provides an encoder in a raster scanning device such as the inkjet printer 80 shown in FIG. 4, which includes an input tray 82 containing a supply 84 of many sheets of printing medium 1. These pass 13 from the tray 82 through a print zone in which they are subject to marking by, preferably, plural pens (also sometimes called "print cartridges" or "printheads") 71*c*, 71*m*, 71*y* and 71*b* carrying cyan, magenta, yellow and black ink respectively—or in any event at least one pen 71*b*, most typically carrying black ink. These pens are preferably of the thermal-inkjet type but may be of other inkjet types.

The sheets proceed from the print zone past an exit 88 into an output tray 86. A movable carriage 70 holds the pen or pens 71 for scanning motion 72 transverse to the motion 13 of the medium.

The front of the carriage 70 has a support bumper (not shown) that rides along a guide (not shown), and the back of the carriage 70 has multiple bushings (not shown) that ride along a slide rod 76. The position of the pen carriage 70 as it bidirectionally traverses 72 the print medium is determined by automatic sensing of an encoder strip 77 and used to selectively fire the various ink nozzles on each pen 71 during each carriage scan. In this way the printer automatically assembles marks—coordinated in position in the two orthogonal directions of movement 72, 13 —to form entire multicolor images based upon user-specified information input to an electronic processor in the printer.

The present invention as expressed in certain of the appended claims is applicable to thermal-inkjet and other inkjet printers using a great variety of mechanical arrangements, including for instance systems in which the paper or other printing medium 1 is effectively tangent to drive wheels or gears—as for example in moving-bed systems such as discussed earlier. The invention is equally applicable in other arrangements for providing relative motion between printing medium 1 and printheads, as for example stationary-bed configurations in which a transverse-motion printhead carriage operates lengthwise as well, gantry style, over the stationary printing medium.

Various ways of employing the information from the two encoders 41, 51 etc. are within the scope of the invention. For example, as the mechanism operates the data-processing system may increment a position count using exclusively pulses from one sensor (the remote-encoder sensor) 51 until feedback is received from another sensor (a direct-encoder sensor) 41—at which point the overall position count is reinitialized based on the information from the other (direct-encoder) sensor 41. As another example, the processing system may update the position as expressed in terms of the direct-encoder scale 142 after each signal pulse from the remote encoder 51.

As still another example, two implementations already discussed can be merged. Thus the use of lookup tables can be combined with the use of plural or multiple encoders 243—by constructing plural or multiple separate lookup tables corresponding to the encoder signals 244*a*, 244*b* respectively, and then averaging the lookup tables.

It will be understood that the foregoing disclosure is intended to be merely exemplary, and not to limit the scope of the invention—which is to be determined by reference to the appended claims.

We claim:

1. Apparatus for controlling print-medium advance in a raster scanning device such as an inkjet printer; said apparatus comprising:

means for engaging and advancing such a print medium;

first position-monitoring means, coupled substantially directly to the engaging-and-advancing means, for providing a first electronic signal representing position of the engaging-and-advancing means;

means for providing a mechanical advantage, said mechanical-advantage means being coupled to the engaging-and-advancing means and having an element that moves in approximate correspondence with motion of the engaging-and-advancing means, but said element also having a mechanical advantage relative to the engaging-and-advancing means;

second position-monitoring means, coupled substantially directly to said element of the mechanical-advantage means, for providing a second electronic signal representing position of said element; and digital electronic means for receiving the first and second electronic signals and combining them to obtain hybrid information representing position of the engaging-and-advancing means.

2. The apparatus of claim 1, wherein:

the engaging-and-advancing means are rotary;

the first signal, provided by the first position-monitoring means, represents angular position of the rotary engaging-and-advancing means.

3. The apparatus of claim 2, wherein the first position-monitoring means comprise:

a single reference pattern mounted for rotary motion with the engaging-and-advancing means; and plural sensors, spaced about an axis of the engaging-and-advancing means, for reading the single reference pattern substantially concurrently and generating respective sensor signals; and means for combining signals from the plural sensors to obtain a signal of relatively high cyclical accuracy, in comparison with each of the plural sensor signals considered individually.

4. The apparatus of claim 1, wherein:

the mechanical-advantage means comprise a gear train, having at least one gear pair, coupled at one end of the train to the engaging-and-advancing means and coupled at the other end of the train to said element of the mechanical-advantage means.

5. The apparatus of claim 1, wherein:

the first monitoring means and first signal have relatively high cyclical accuracy but are subject to relatively low resolution, in comparison with the second monitoring means and second signal;

the motion of the element, and accordingly the second monitoring means and second signal, have relatively high resolution but are subject to relatively lower cyclical accuracy, in comparison with the first monitoring means and first signal; and the digital electronic means comprise means for combining the signals to obtain hybrid information whose:

cyclical accuracy is established by the cyclical accuracy of the first monitoring means, and resolution is established by the resolution of the second monitoring means.

6. The apparatus of claim 1, wherein the digital electronic means comprise means for combining the signals by using:

the first signal to establish absolute position of the engaging-and-advancing means; and the second signal to establish relative position between absolute positions determined from the first signal.

7. The apparatus of claim 6, wherein:

the first signal comprises electronic pulses that are counted;

the second signal comprises electronic pulses that are counted; and the digital electronic means comprise means for combining the signals by using pulses of the second signal to establish relative position between pulses of the first signal.

8. The apparatus of claim 6, wherein the digital electronic means further comprise:

means for comparing the first and second signals to determine cyclical error in the second signal; and means for applying said determined cyclical error to refine the second signal as used to establish relative positions between absolute positions determined from the first signal.

9. The apparatus of claim 1, wherein the digital electronic means comprise:

means for comparing the first and second signals to determine cyclical error in the second signal;

means for applying said determined cyclical error to derive from the second signal a unitary signal that has relatively very high cyclical accuracy; and means for using the derived unitary signal to represent the position of the engaging-and-advancing means.

10. The apparatus of claim 9, wherein:

said error-applying means comprise means for forming a digital electronic lookup table correlating tabulated values of the second signal with tabulated values of the high-cyclical-accuracy unitary signal; said tabulated values of the high-cyclical-accuracy unitary signal constituting said hybrid information; and said derived-signal-using means comprising means for using tabulated values of the high-cyclical-accuracy unitary signal to represent the position of the engaging-and-advancing means.

11. The apparatus of claim 1, further comprising:

motive means, such as a motor, for driving the engaging-and-advancing means, coupled to the engaging-and-advancing means through the mechanical-advantage means;

wherein the second position-monitoring means monitor the position of the motive means substantially directly.

12. The apparatus of claim 11, wherein:

the second position-monitoring means comprise an encoder coupled substantially directly to the motive means.

13. The apparatus of claim 11, wherein:

the second position-monitoring means comprise a stepping drive mechanism that is part of the motive means.

14. The apparatus of claim 1, wherein:

the engaging-and-advancing means comprise at least one rotary roller which in operation undergoes rotation;

the first position-signal-developing means comprise a rotary encoder;

the first signal represents angular position of the rotary roller; said the mechanical-advantage means comprise a gear train coupled to the roller, and said element of the mechanical-advantage means comprises a shaft that rotates in approximate correspondence with the roller, but which shaft has a mechanical advantage relative to the roller so that the shaft undergoes greater rotation than the corresponding rotation of the roller;

the second position-signal-developing means are coupled to the shaft, and said second signal represents angular position of the shaft; and said hybrid information, obtained by the digital electronic means, represents position of the roller.

15. The apparatus of claim 14, further comprising:

a motor, integral with said shaft, to drive the roller means through the gear train.

16. The apparatus of claim 14, wherein the rotary encoder comprises:

a pattern of indicia defined on a surface of a gear that is secured to the roller means and that is a first gear of the gear train; and a reflection sensor disposed to read the indicia.

17. The apparatus of claim 1 incorporated into a printer, and in further combination with other printer elements comprising:

print-medium supply means for holding a quantity of such print medium for use in the printer;

print-medium receipt means for receiving print medium after use in the printer;

first motive means for driving the engaging-and-advancing means to move such print medium from the supply means and through the printer;

at least one pen for marking on such print medium;

pen-carriage means supporting the at least one pen for scanning motion relative to such print medium, transverse to print-medium motion through such printer;

second motive means for driving the pen-carriage means in said scanning motion;

automatic means, integrated with the digital electronic means, for operating said second motive means and for operating said marking by the pen; and a case for supporting and holding in operating relationships the engaging-and-advancing means, first and second position-monitoring means, mechanical-advantage means, element, print-medium supply and receipt means, pen, pen-carriage means, first and second motive means, digital electronic means, and automatic operating means.

* * * * *